US008061563B1

(12) United States Patent
Rosen

(10) Patent No.: US 8,061,563 B1
(45) Date of Patent: Nov. 22, 2011

(54) FLEXIBLE POUCH WITH EXPULSION AID

(75) Inventor: Ian K. Rosen, North Muskegon, MI (US)

(73) Assignee: AGS I-Prop, LLC, Muskegon, MI (US)

( * ) Notice: Subject to any disclaimer, the term of this patent is extended or adjusted under 35 U.S.C. 154(b) by 629 days.

(21) Appl. No.: 11/754,650

(22) Filed: May 29, 2007

(51) Int. Cl.
*B65D 35/00* (2006.01)

(52) U.S. Cl. ..... 222/107; 206/484

(58) Field of Classification Search ..... 222/92–107; 206/824, 277, 260, 484, 245, 271; 383/207, 383/906
See application file for complete search history.

(56) References Cited

U.S. PATENT DOCUMENTS

| | | | | |
|---|---|---|---|---|
| 2,103,389 | A * | 12/1937 | Salfisberg | 222/107 |
| 2,329,360 | A * | 9/1943 | Salfisberg | 206/484 |
| 2,637,872 | A | 5/1953 | Holbrook | |
| RE24,251 | E | 12/1956 | Kaplan et al. | |
| 2,896,381 | A | 7/1959 | Lange | |
| 3,009,498 | A | 11/1961 | Fohr | |
| 3,128,920 | A | 4/1964 | Volckening et al. | |
| 3,163,971 | A | 1/1965 | Loliger et al. | |
| 3,184,121 | A * | 5/1965 | Volckening | 222/213 |
| 3,189,227 | A | 6/1965 | Hobbs et al. | |
| 3,224,640 | A | 12/1965 | Schneider et al. | |
| 3,278,085 | A * | 10/1966 | Brown Royce | 222/107 |
| 3,524,537 | A | 8/1970 | Winter | |
| 3,741,778 | A | 6/1973 | Rowe | |
| 3,783,581 | A | 1/1974 | Pierce | |
| 3,789,569 | A | 2/1974 | Egger | |
| 3,815,794 | A | 6/1974 | Carlisle | |
| 3,862,684 | A | 1/1975 | Schmitt | |
| 3,865,157 | A | 2/1975 | Knabe et al. | |
| 3,878,977 | A | 4/1975 | Carlisle | |
| 3,911,642 | A | 10/1975 | Ernstsson et al. | |
| 3,913,734 | A | 10/1975 | Siegel | |
| 3,913,789 | A * | 10/1975 | Miller | 222/107 |
| 3,922,835 | A | 12/1975 | Reil | |
| 4,045,939 | A | 9/1977 | Baumstingl | |
| 4,163,509 | A | 8/1979 | Amneus | |
| D253,040 | S | 10/1979 | Fournier et al. | |

(Continued)

FOREIGN PATENT DOCUMENTS

JP 57023666 A 2/1982

OTHER PUBLICATIONS

Exhibits A-D include photos of various packets believed to be on sale more than one year prior to the filing date of this application.

*Primary Examiner* — Lien Ngo
(74) *Attorney, Agent, or Firm* — Gardner, Linn, Burkhart & Flory LLP

(57) ABSTRACT

A container for containing a flowable material includes first and second sheet portions selectively sealed together along a perimeter of said container to define a closed cavity for containing the flowable material therein. The cavity includes a dispensing portion at a periphery of the container, with the dispensing portion being configured for dispensing the flowable material from the cavity when the dispensing portion is opened. The base and/or the side regions of the container may comprise at least one substantially rigid region with at least one weakened portion to facilitate folding of the base and/or side regions at the weakened portion or portions to assist in dispensing the flowable material from the container.

88 Claims, 3 Drawing Sheets

U.S. PATENT DOCUMENTS 4,199,915 A 4/1980 Levine
4,252,257 A 2/1981 Herzig
4,328,912 A 5/1982 Haggar et al.
4,417,607 A 11/1983 Scholle et al.
4,491,245 A 1/1985 Jamison
4,566,249 A 1/1986 Schwerdtel et al.
4,671,452 A 6/1987 Pupp et al.
4,683,701 A 8/1987 Rangwala et al.
4,707,334 A 11/1987 Gerhard
4,769,974 A 9/1988 Davis
4,921,137 A 5/1990 Heijenga
4,988,016 A 1/1991 Hawkins et al.
5,018,646 A 5/1991 Billman et al.
5,020,303 A 6/1991 Vokins
5,029,430 A 7/1991 Davis
5,072,855 A 12/1991 Herzig
5,111,932 A 5/1992 Campbell
5,368,828 A 11/1994 Carlson
5,377,475 A 1/1995 Haarer et al.
5,378,065 A * 1/1995 Tobolka ..... 383/9
5,398,734 A 3/1995 Hartel
D368,428 S 4/1996 Croft
5,529,224 A 6/1996 Chan et al.
5,660,100 A 8/1997 Spelten et al.
5,826,737 A * 10/1998 Zakensberg ..... 215/47
5,839,609 A 11/1998 Zakensberg
5,897,833 A 4/1999 Hunt et al.
5,971,225 A 10/1999 Kapsa
5,996,845 A 12/1999 Chan
6,094,887 A 8/2000 Swank et al.
6,096,265 A 8/2000 Mezger et al.
6,120,730 A 9/2000 Palaniappan et al.
6,129,959 A 10/2000 Mercer et al.
6,220,756 B1 * 4/2001 Darmstadter ..... 383/207
6,244,467 B1 * 6/2001 Lewit ..... 222/107
6,247,617 B1 6/2001 Clyde et al.
6,260,735 B1 * 7/2001 Fuquen ..... 222/94
D446,720 S * 8/2001 Qvortrup ..... D9/428
6,332,560 B1 * 12/2001 Rosenberg ..... 222/107
6,431,227 B1 8/2002 Ter Haar
D464,257 S * 10/2002 Gates ..... D9/707
D466,404 S * 12/2002 Gates ..... D9/707
6,557,731 B1 5/2003 Lyon et al.
6,622,457 B2 9/2003 Kurth
6,626,296 B1 9/2003 Jimu et al.
6,629,401 B1 10/2003 Hins et al.
6,666,002 B1 12/2003 Otsuka et al.
D484,972 S * 1/2004 Steele et al. ..... D24/118
6,691,747 B1 2/2004 Marcus et al.
6,718,735 B2 4/2004 Lewis, Jr. et al.
6,752,959 B2 6/2004 Smith et al.
6,786,249 B2 9/2004 Armbruster et al.
6,786,515 B2 9/2004 Franko, Sr.
6,912,825 B2 * 7/2005 Kothari ..... 53/133.2
6,935,783 B2 * 8/2005 Carter ..... 383/207
7,007,823 B2 * 3/2006 Jackson ..... 222/99
D527,274 S * 8/2006 Edwards ..... D9/600
2002/0029543 A1 3/2002 Taggart
2002/0083682 A1 7/2002 Edwards et al.
2003/0152300 A1 * 8/2003 Tu et al. ..... 383/207

* cited by examiner

FLEXIBLE POUCH WITH EXPULSION AID

FIELD OF THE INVENTION

The present invention relates generally to containers for containing flowable material and, more particularly, to sealed containers or pouches having opposed sheets sealed together around their perimeter regions to define a cavity between the sealed sheets for containing the flowable material.

BACKGROUND OF THE INVENTION

It is known to provide a container or package or pouch for holding a flowable material that has two opposed sheet portions that are sealed together around their perimeter regions to define a cavity within the pouch and between the unsealed portions of the opposed sheets. Such flexible pouches are commonly used for ketchup, mayonnaise, creams, gels, liquids and the like, and involve either two sheets of a flexible film or a fold over of a single sheet of flexible film, and adhesion or heat sealing along the perimeter edges or regions of the sheets so as to form a low cost small pouch containing the flowable material. The packages typically have an opening or tear off portion of flexible material to provide an opening for expulsion of the contents of the pouch. The dispensing end or portion of the container thus may be cut or torn to open or expose an opening for dispensing the material from the cavity of the container.

When opened, the container may be squeezed to force the flowable material within the container through the dispensing opening and onto the targeted object or surface. However, when a user squeezes the pouch, the material is forced in all directions within the pouch (typically a rectangular-shaped pouch) and not entirely toward and through the dispensing end or opening of the pouch. Thus, the user may have to selectively squeeze different regions of the pouch to attempt to force all of the material through the dispensing end or opening of the pouch. The problem is that finger pressure on the pouch drives some of the contents out of the opening, but typically forces or urges some of the flowable material in directions within the pouch other than toward the opening.

It is also known to provide a dispensing tube, where the end of the tube opposite the dispensing opening may be rolled up toward the dispensing opening to help force the material from within the tube through the dispensing opening of the tube. However, such tubes, typically as used for toothpaste and the like, are formed with a molded dispensing end attached to a flexible tube, and filled from the opposite end of the tube, whereby the end of the tube is sealed. Thus, such tubes may be costly to manufacture as compared to pouches formed from opposed sheet portions sealed together about their perimeter regions. Further, although such tubes allow a user to roll up the end of the tube toward the dispensing end, the rolling up of the tube is not controlled, and thus may not result in expulsion of all of the material within the tube.

Although it is known to provide such rollup tubes, such as for toothpaste or the like, it is difficult to roll up the low cost flexible pouches, since such pouches are relatively formless and various separate clips that may be used to assist in rolling or folding the pouches may add significantly to the cost and complexity of the economical pouches. Such additional costs are difficult to justify for such low cost flexible pouches, since such pouches are often used for samples of products, such as shaving gel or skin moisturizer, as well as single use applications of products, such as glue, grease, oil lubricant and/or the like.

SUMMARY OF THE INVENTION

The present invention provides a pouch or package or container for containing a flowable material, with the container being formed from sealed opposed sheet portions that are sealed about the perimeter regions to form a cavity or pouch between the unsealed portions of the sheets. The sealed base and/or side regions of the container are substantially rigid and have one or more weakened regions or creases or notches to facilitate controlled folding of the pouch or package to urge or force the flowable material within the pouch toward the dispensing end of the pouch as the pouch is folded from its end opposite the dispensing end. The pouch or package or container of the present invention thus provides an enhanced expulsion means or expulsion aid for expelling and dispensing the material from within the sealed pouch, and does so by utilizing the structure of the container (without additional costly elements or components) to more completely dispense the fluid from within the container.

According to an aspect of the present invention, a container containing a flowable material includes first and second sheet portions that are selectively sealed together about their periphery to define a closed cavity for containing the flowable material. The cavity includes a dispensing portion at a perimeter region or end of the container, with the dispensing portion being configured for dispensing the flowable material from the cavity when the dispensing portion is opened. The sealed perimeter includes a base and opposite side regions of the container, with the base being at a perimeter region or end generally opposite the dispensing portion. At least one of the base and the side regions of the container comprise at least one substantially rigid region with at least one weakened portion to facilitate folding of the side regions at the weakened portions to assist in dispensing the flow of the material from the container.

Optionally, the dispensing portion or end may be opened by cutting or tearing the container at or near the dispensing end, such as via removal of a portion of the low cost container itself rather than costly additions (such as a cap or the like) to the container. The weakened portion or portions may comprise notches, such as graduated notches or the like, established at or along substantially rigid base and/or side regions of the container (such as via removal of a portion of the low cost container), with the notches of one side region generally corresponding to the notches of the other side region to facilitate folding of the container at the corresponding notches. Optionally, the weakened portion or portions may comprise one or more creases established at the base and/or side regions to facilitate folding of the container at the corresponding creases. Optionally, the container may include indicia established thereon (such as via printing or screening or the like, and such as part of the printing or screening of the text and graphics on the sheet portions of the container), such as fastener indicia and/or fold line indicia or the like, to provide an indication to the user that the container is to be folded at the weakened portions to assist the user in using the container for its intended purpose.

In one form, the side portions of the container may comprise substantially rigid side portions with weakened portions spaced therealong. Optionally, a gap or spacing between consecutive weakened portions may be progressively greater for each set of weakened portions approaching the dispensing end of the container.

In another form, the base of the container may comprise a substantially rigid sealed base, and may be foldable along a selectively weakened portion or crease of the base to form an expulsion element, such as a squeegee or squeegee clip or trowel or scraper or the like, to assist in folding the container at the weakened portions of the substantially rigid side regions and forcing the flowable material toward the dispensing end and out the dispensing opening of the container. The base thus may comprise a grasping element or clip or other element that enhances the folding of the container to enhance expulsion of the flowable material from the container.

According to another aspect of the present invention, a method for expelling flowable material from a sealed pouch or container includes providing first and second sheet portions and selectively sealing the sheet portions together along a perimeter region of the container to define a closed cavity for containing a flowable material therein. The perimeter includes a base and opposite side regions of the container, and the cavity includes a dispensing portion at a periphery of the container. The base and/or the side regions of the container may comprise substantially rigid regions with at least one weakened portion. The dispensing portion of the container is opened and the rigid region is folded at a first one of the weakened portion or portions to assist in dispensing the flowable material through the opened dispensing portion and from the container.

Optionally, the first weakened portion may be at the side regions, while a second weakened portion or portions may also be at the side regions and closer to the dispensing portion or end or opening of the container than the first weakened portion or portions. Optionally, the first weakened portion may be at the base, while a second weakened portion be at the side regions. The base may be folded to at least partially overlay the cavity region of the pouch container, and the base may be squeezed or urged against the cavity portion to force or expel the flowable material from the pouch container. The side regions may be folded at the second one of the weakened portions to further dispense the material from the container.

Therefore, the method or container or flexible pouch of the present invention provides enhanced expulsion means for forcing and dispensing flowable material from within a flexible sealed pouch. The substantially rigid base and/or side regions of the pouch provide structural rigidity to the flexible pouch, while the selectively spaced apart weakened regions of the sides of the pouch allow for selective folding of the pouch in a controlled manner to assist the user in forcing the flowable material within the sealed pouch toward and through a dispensing opening of the pouch. The expulsion means of the present invention provide enhanced expulsion of the fluid or flowable material within the pouch and are integrally formed with the low cost flexible pouch so as to provide such enhanced expulsion of the flowable material without additional or costly elements or moldings. The present invention may have the weakened portions or notches formed or established via removal of portions of the existing side regions or base, or via creasing or otherwise weakening the existing side regions, and thus without adding a costly additional element, such as a separate clip or the like, such that the container or flexible pouch of the present invention provides a controlled expulsion means for a low cost container or pouch.

These and other objects, advantages, purposes and features of the present invention will become apparent upon review of the following specification in conjunction with the drawings.

DESCRIPTION OF THE PREFERRED EMBODIMENTS

Figure 1:
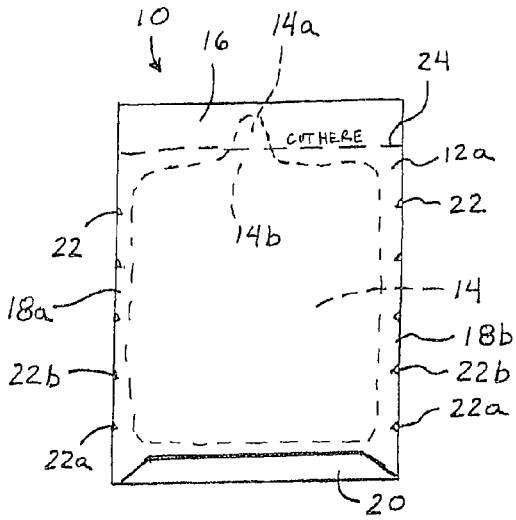
FIG. 1 is a plan view of a flexible pouch in accordance with the present invention.
Figure 2:
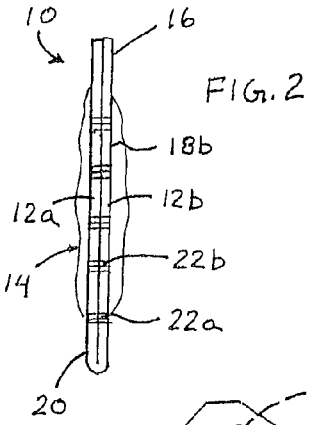
FIG. 2 is a side elevation of the flexible pouch of FIG. 1.

Referring now to the drawings and the illustrative embodiments depicted therein, a flexible pouch or package or container 10 is formed of opposed flexible sheets or sheet portions 12*a*, 12*b* that are sealed together around their perimeter regions to define a cavity 14 within the pouch and between the unsealed portions of the sheets 12*a*, 12*b* for holding a flowable material therein (FIGS. 1 and 2). The pouch 10 includes a sealed header portion 16, sealed opposite side perimeter regions or portions 18*a*, 18*b*, and a sealed base region or portion 20. In the illustrated embodiment of FIGS. 1 and 2, the side perimeter regions 18*a*, 18*b* comprise substantially rigid side perimeter regions and include weakened portions or elements 22 spaced therealong to facilitate folding of the container to assist in expulsion of the flowable materials within the container, as discussed below.

The flexible sheet portions or film or films of the pouch may be sealed along the perimeter regions via any known or suitable sealing means. For example, the pouch may be heat sealed or adhered about its perimeter regions to seal the perimeter regions of the pouch and to define the pouch within the perimeter regions and between the unsealed portions of the sheets or films. The pouch may comprise two opposite sheet portions that are selectively sealed together around their perimeter regions, or may comprise a single sheet portion that is folded over on itself to form the two opposed sheet portions of the pouch, while remaining within the spirit and scope of the present invention. The flexible pouch may utilize aspects of the flexible pouches described in U.S. Pat. No. 6,905,075 and/or U.S. patent application Ser. No. 10/818,775, filed Apr. 6, 2004 for CONTAINER FOR FLOWABLE PRODUCTS, now U.S. Pat. No. 7,241,066, which are hereby incorporated herein by reference in their entireties.

As can be seen in FIG. 1, the pouch 10 is sealed along its perimeter regions to define the cavity 14, and includes a dispensing portion 14*a* that extends through and beyond a cut line or opening line or detaching line 24 of pouch 10. Thus, a user may cut or tear along the opening line 24 of pouch 10 (such as an opening line at or at least partially across or through header portion 16), whereby a dispensing opening 14*b* is exposed or opened via the cutting or tearing or opening of the pouch through the dispensing portion 14*a* of cavity 14.

The side regions 18*a*, 18*b* of pouch 10 are formed so as to be at least partially and preferably substantially rigid to resist or limit bending or folding of the side regions 18*a*, 18*b*, except at the weakened portions 22 spaced along the side regions 18*a*, 18*b*. The rigidity or strengthening of the side regions may be provided via any suitable means, such as via establishing ridges or ribs or corrugations along the side regions to limit or resist bending, or such rigidity may be provided via the heat sealing or adhesive process or via indentations or the like formed along the side regions to add strength to the side regions. Although the side regions and/or base of the container or pouch may be semi-rigid or non-flexible, the un-sealed portions of the sheet portions (that define the cavity for containing the flowable material) remain flexible to allow for compression of the sheet portions toward one another to expel the flowable material from within the cavity.

The spaced apart weakened portions 22 are formed or established at and along the side regions to allow for bending or flexing of the side regions at the selectively weakened portions. As can be seen in FIG. 1, the weakened portions may be disposed or established at approximately the same region at and along the respective side portion or region to facilitate the bending of the pouch across the pouch and generally along a fold-line extending between the respective or corresponding weakened portions 22. Optionally, the pouch container may include indicia thereon to demarcate or indicate the location of the weakened portions so that a user may readily discern where to fold the container during use.

In the illustrated embodiment, weakened portions 22 comprise a series of notches formed in the side regions 18*a*, 18*b* and spaced along each of the side regions 18*a*, 18*b*. Although shown as notches formed or established along the side regions of the pouch, the weakened portions may comprise any other suitable weakening means for selectively weakening the side regions of the pouch at the spaced apart locations. For example, the weakened portions may comprise creases or indentations or slight perforations at least partially across the respective side regions to facilitate folding of the side regions of the pouch at the respective weakened portions or regions of the pouch. Other suitable weakening means or elements or configurations may be implemented at spaced apart regions along the sides of the pouch while remaining within the spirit and scope of the present invention.

Optionally, the weakened regions may be substantially evenly spaced or distributed along the respective side portions, or the weakened regions may be unevenly spaced along the respective side regions (such as discussed in detail below), while remaining within the spirit and scope of the present invention. Such an increased longitudinal space (the space along the side portions) between the adjacent or consecutive weakened portions may accommodate the increase in size or longitudinal dimension of the base and folded portions of the folded up pouch as the pouch is folded multiple times toward its dispensing end. However, other suitable spacings or configurations of weakened regions or elements along the side portions of the sealed pouch may be implemented.

The base portion 20 may also comprise a substantially rigid portion of the pouch, such that a user may grasp the base portion 20 to fold the pouch at the weakened portions, whereby the substantially rigid base portion will resist bending or flexing during the folding and expulsion process. Optionally, the base portion 20 may form or utilize or incorporate or receive a grasping element or clip to further enhance the user's ability to readily grasp the base portion and fold the container at the weakened portions to force the flowable material toward the dispensing end and out of the dispensing opening of the pouch. The pouch may utilize the relatively stiff base and/or sealing edges of the flexible pouch to make a clip that can be moved toward the evacuation opening to efficiently direct the flowable product within the pouch toward and through the evacuation opening, even to the extent of creating enough pressure to squirt the flowable product if desired, such as by building up a controllable pressure within the pouch via the folding of the pouch at the weakened regions of the side portions of the pouch.

When the dispensing opening of the pouch is opened or exposed (such as via tearing or cutting the header portion), the fluid or flowable material may be dispensed from the pouch via selective folding of the pouch at the weakened portions of the side regions. As the base 20 is folded over the pouch via bending of the pouch at the lowermost weakened portions (in other words, the weakened portions that are furthest from the dispensing end 14*b*, such as the weakened portion 22*a* of side regions 18*a*, 18*b*, or such as a weakened portion at the base), the flowable material within the pouch is directed or forced or urged toward and through the dispensing opening 14*b*. Further folding of the pouch at the next weakened portion 22*b* urges and dispenses additional flowable material from the pouch 10. This process may be repeated until the pouch is substantially or entirely emptied of its flowable material or contents.

The substantially rigid or relatively stiff bottom and/or side sealed regions of the pouch thus may be utilized to make a low cost clip or folding element or expulsion aid without adding any new components or elements to the sealed pouch. Thus, the present invention provides a low cost flexible pouch, such as a generally rectangular-shaped pouch, made of opposed sheets or sheet portions sealed together around their perimeter regions, and provides for controlled expulsion of the flowable pouch via the selective folding of the pouch at the weakened regions spaced along the substantially rigid or relatively stiff side regions of the pouch.

Figure 3:
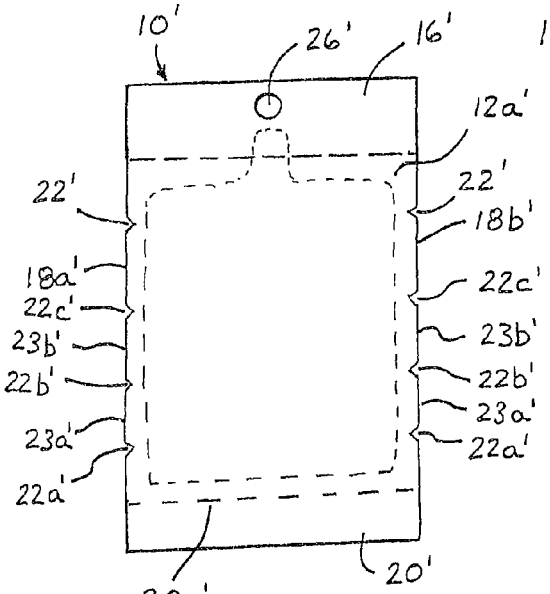
FIG. 3 is a plan view of another flexible pouch in accordance with the present invention.
Figure 4:
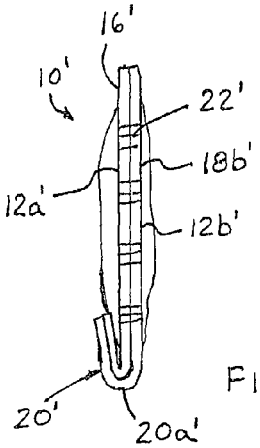
FIG. 4 is a side elevation of the flexible pouch of FIG. 3.

Optionally, and with reference to FIGS. 3 and 4, a flexible pouch or container 10' may comprise opposed sheets or sheet portions 12*a*', 12*b*', which are sealed around their perimeter regions to define a pouch 14' within the perimeter regions and between the unsealed portions of the sheet portions 12*a*', 12*b*'. The side regions 18*a*', 18*b*' of the generally rectangular-shaped pouch 10' are substantially rigid side regions and have weakened portions 22' formed or established at intervals therealong to assist in folding or bending or flexing of the substantially rigid side regions, such as in a similar manner as described above. In the illustrated embodiment, base portion 20' of pouch 10' comprises a foldable base portion, and has a weakened portion or crease 20*a*', whereby the substantially rigid base portion 20' may be folded over on itself (as shown in FIG. 4) by a user to provide a thicker or wider grasping element or clip type element to assist the user in folding the pouch to direct and force the flowable material within the pouch toward and through the dispensing opening of the pouch.

Optionally, the base portion 20' may be folded at the weakened portion 20*a*' such that a portion of the base folds over or overlays or encompasses a portion of the pouch or cavity (such as can be seen with reference to FIG. 4, where the base is partially folded at the weakened portion and acts against or at least partially compresses the flexible pouch portion of the container) and thus acts to assist in urging or forcing the flowable material within the cavity toward and out the dispensing opening, such as in a similar manner as accomplished via the weakened portions along the side regions, as discussed above. The base portion thus may be sized to provide a desired degree of overlap of the pouch when the base portion is folded at the weakened portion to provide a foldable base to assist in dispensing the flowable material from the pouch container.

Optionally, and as shown in FIG. 3, a header portion 16' of pouch 10' may include a hanging means or aperture 26' therethrough, so that the pouch 10' may be readily hung from a peg or rod or hook or the like, such as for a pegboard display or the like. Pouch 10' may be otherwise substantially similar to pouch 10, discussed above, such that a detailed discussion of the pouches need not be repeated herein.

Optionally, and as discussed above, the weakened regions may be substantially evenly spaced or distributed along the respective side portions, or the weakened regions may be unevenly spaced along the respective side regions, while remaining within the spirit and scope of the present invention.

For example, the space or gap or substantially rigid or unweakened portion of the sides may be incrementally or progressively greater for each set of adjacent weakened portions toward the dispensing end. For example, and with reference to FIG. 3, a gap or unweakened edge portion 23*a*' between a first weakened portion 22*a*' and a second weakened portion 22*b*' of each side 18*a*', 18*b*' of the container 10' may be less than or smaller than a gap or unweakened edge portion 23*b*' between the second weakened portion 22*b*' and a third weakened portion 22*c*' of each of the sides 18*a*', 18*b*' of container 10', and so on along the length of the container and toward the dispensing end of the container. Such an increased space or distance between the adjacent or consecutive weakened portions may accommodate the increase in size of the folded-up pouch as the pouch is folded multiple times toward its dispensing end. However, other suitable spacings or configurations of weakened regions or elements along the side portions of the sealed pouch may be implemented while remaining within the spirit and scope of the present invention.

Figure 5:
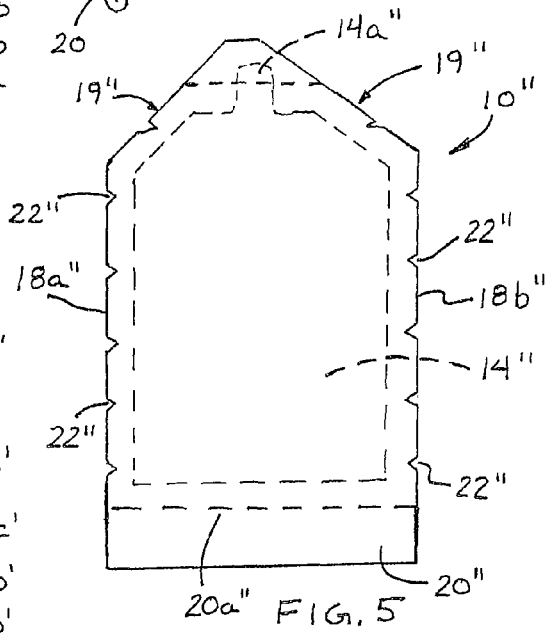
FIG. 5 is plan view of another flexible pouch in accordance with the present invention.

Optionally, and as shown in FIG. 5, a container or pouch 10", which may be substantially similar to container or pouch 10 or container or pouch 10', discussed above, may include a tapered dispensing end region to assist in directing the flowable material within the pouch toward a dispensing portion 14*a*" and dispensing opening 14*b*" of the fluid containing cavity 14" when the base portion 20" is folded over the pouch (such as at a weakened portion or crease 20*a*") and/or the pouch is folded along the substantially rigid side regions 18*a*", 18*b*" and at the weakened portions 22" of the side regions, such as in a similar manner as described above. As can be seen in FIG. 5, the dispensing end portion of the pouch 10" has tapered side regions or shoulders 19" to define a generally tapered cavity 14" that is tapered toward the dispensing and portion 14*a*" and dispensing opening 14*b*". Pouch 10" may be otherwise substantially to pouches 10 and/or 10', discussed above, such that a detailed discussion of the pouches need not be repeated herein. The pouch may be formed in any suitable or desired shape, such as a generally rectangular-shaped pouch or tapered shape or the like, while remaining within the spirit and scope of the present invention.

Figure 6:
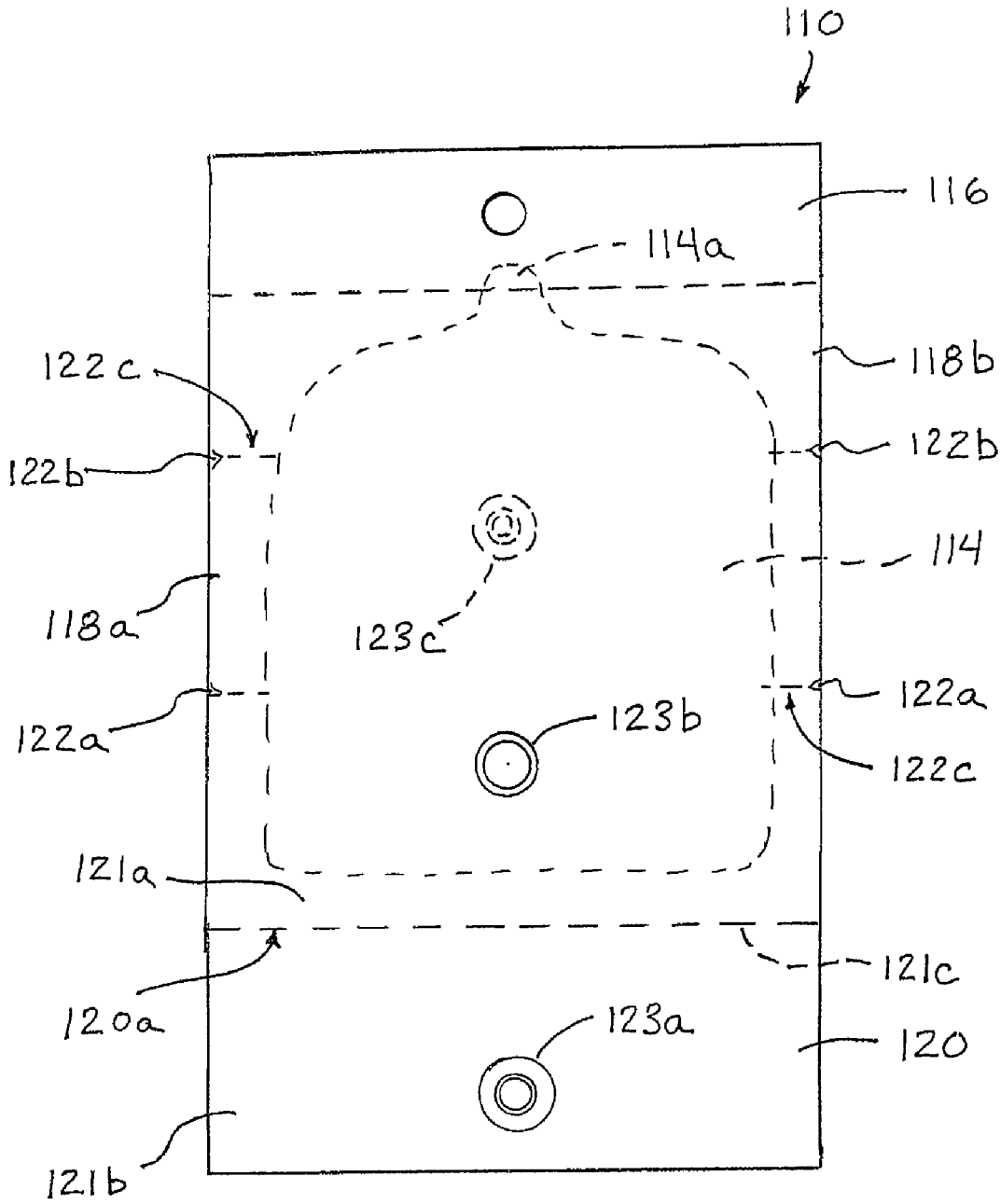
FIG. 6 is a plan view of another flexible pouch in accordance with the present invention.

Optionally, and with reference to FIG. 6, a flexible pouch or package or container 110 is formed of opposed flexible sheets or sheet portions that are sealed together around their perimeter regions to define a cavity 114 within the pouch and between the unsealed portions of the sheets for holding a flowable material therein, such as in a similar manner as described above. The pouch 110 includes a sealed header portion 116, sealed opposite side perimeter regions or portions 118*a*, 118*b*, and a sealed base region or portion 120. The sealed base 120 comprises a substantially rigid base with a weakened region or portion 120*a* extending at least partially thereacross so that base 120 can be readily folded at the weakened portion 120*a* (which may be across the base as shown in FIG. 6 or may be at or near the end of the cavity opposite the dispensing portion) to assist in expulsion of the flowable material from within the cavity 114 of pouch 110.

As can be seen in FIG. 6, base 120 has an upper or first base portion or region 121*a* generally at an end region of the cavity (and opposite the dispensing end or region 114*a* of cavity 114) and a lower or second base portion or region 121*b* extending from the first base portion and away from the cavity. The weakened portion 120*a* is located or established or disposed where the first and second base portions oppose one another or join. The base 120 thus may be folded at the weakened portion 120*a* whereby the base portion 121*b* is folded (such as generally upward in FIG. 6) so as to at least partially overly the sheet portion at the cavity region of the container, whereby the user may squeeze the folded base portion to urge the base portion 121*b* against the respective sheet portion at the cavity of the container to expel the flowable material from the cavity of the pouch or container. As shown in FIG. 6, the base 120 may be foamed or sized so that the lower or second base portion 121*b* extends at least partially, and preferably substantially, over the cavity region of the pouch when the base is folded at the weakened portion. Thus, urging or squeezing the second or lower base portion toward the cavity region of the pouch may act to force or squeegee the flowable material within the cavity toward the dispensing end or portion 114*a* of the cavity 114 of the pouch container 110.

Optionally, the sheet portion or portions of the pouch may have indicia thereon to assist a user in recognizing or discerning the foldable feature of the pouch. For example, and with reference to FIG. 6, the pouch 110 may have a first fastener portion or element or indicia 123*a* printed or screen printed or otherwise established at the second or lower base portion 121*b*, and a second fastener portion or element or indicia 123*b* printed or screen printed or otherwise established at the first or upper base portion 121*a* and/or at the cavity 114 (such as shown in FIG. 6). The fastener indicia 123*a*, 123*b* are graphical representations that are indicative or representative of first and second fastener portions (such as male and female fastener portions, such as snap elements or the like), and are established at the sheet portion in a manner whereby the first and second indicia 123*a*, 123*b* may be generally aligned when the second base portion 121*b* is folded generally over the first base portion 121*a* and the cavity 114. The first and second fastener indicia thus provide an indication to the user of the pouch container that the second base portion is to be folded at the weakened portion of the base so that the second base portion at least partially overlaps or overlies the cavity portion of the container. Optionally, the base portion may also or otherwise include indicia 121*c* across or partially across the base portion 120 and generally at the weakened portion 120*a* to provide an indication of where the base portion is to be folded (such as a dashed line or text, such as "fold here", or the like). Such indicia or demarcation is particularly useful when the weakened portion of the base is a crease or other form of weakening of the base and thus may not be readily discernible to the user of the container.

The base 120 of the container 110 thus may be folded to provide an assist feature or function for the expulsion of the flowable material from the cavity of the container. Optionally, the weakened portion of the base 120 may be at the lower end of the cavity, such that substantially the entire base is folded over the cavity portion, whereby the first or upper base portion may actually be at the lowermost portion of the cavity itself. Optionally, the container 110 may include substantially rigid side regions 118*a*, 118*b* with one or more weakened portions 122*a*, 122*b* established along the respective side regions 118*a*, 118*b* to assist in folding of the container at the weakened portions along the side regions, such as in a similar manner as discussed above. Optionally, the container may include indicia or demarcations 122*c* at the side weakened portions 122*a*, 122*b* and/or across or partially across the container between the respective weakened portions (such as the dashed lines 122*c* at the side regions 118*a*, 118*b* in FIG. 6) to indicate to the user that the container is to be folded at those areas. Such indicia or demarcation is particularly useful when the weakened portions are creases or other form of weakening of the side regions and thus may not be readily discernible to the user of the container.

A user of the container 110 may tear or cut the header portion 116 of container 110 to open the dispensing end or portion 114*a*, and may then fold the base 120 (at the weakened portion 120*a*, such as notches or a crease or perforation at least partially across the base) and squeeze or urge the lower or second base portion 121*b* toward and against the cavity region of the container to expel some of the flowable material from the cavity 114. The user may then further fold the container 110 at the first weakened portion 122*a* of the side regions 118*a*, 118*b* to expel more of the flowable material from the cavity, and may further fold the container at the second weakened portion 122*b* of the side regions 118*a*, 118*b* to expel more of the flowable material from the cavity of the container. The substantially rigid base and/or side regions with one or more weakened portions (such as creases, notches, perforations or the like) thus provide a controlled folding of the container to expel substantially all of the contents of the container in a controlled manner. Although shown as having two weakened portions 122*a*, 122*b* along the side regions 118*a*, 118*b*, clearly more or less weakened portions may be provided depending on the particular container, while remaining within the spirit and scope of the present invention.

Optionally, additional indicia may be provided to provide a step-by-step indication of the folding feature of the container. For example, the container may be marked as shown in FIG. 6, and may include a third fastener indicia (such as the fastener indicia 123*c* shown in FIG. 6) at or on the first or front sheet portion closer to the dispensing end from fastener indicia 123*a*. The second or rear or opposite sheet portion of the container may include a fourth fastener indicia (not shown in FIG. 6) established thereon and at a rear side of the base (or opposite side from where the fastener indicia 123*a* is established), such that, when the base is folded at the weakened portion 120*a*, the rear surface of the base (with the fourth indicia established thereon) is viewable by the user, and the user can readily recognize that the next step is to fold the container again so that the fourth fastener indicia generally aligns with the third fastener indicia, and so on.

Optionally, the fastener indicia may be selected so that it is clear to the user as to which fastener indicia match or go together. For example, fastener indicia 123*a* may represent a male fastener element, while fastener indicia 123*b* may represent a female fastener element so that a user may readily understand the folding process. Likewise, fastener indicia 123*c* may represent a male fastener (so that a user is less likely to fold the base and fastener indicia 123*a* too far along the container since the two male fasteners would not intuitively go together), and the fastener indicia at the back of the base portion may represent a female fastener to correspond with the male fastener indicia 123*c*, and so on. Other indicia, such as color coded or alphanumeric indicia or the like, may be utilized to assist the user in folding the container at each of the weakened portions, while remaining within the spirit and scope of the present invention. The fastener indicia thus may be spaced apart along both the front and rear sheet portions of the container to provide step-by-step or fold-by-fold instructions or map or guide to assist the user in recognizing the foldable feature and folding the container at the weakened portions to expel the flowable material from within the cavity in a controlled manner.

Figure 7:
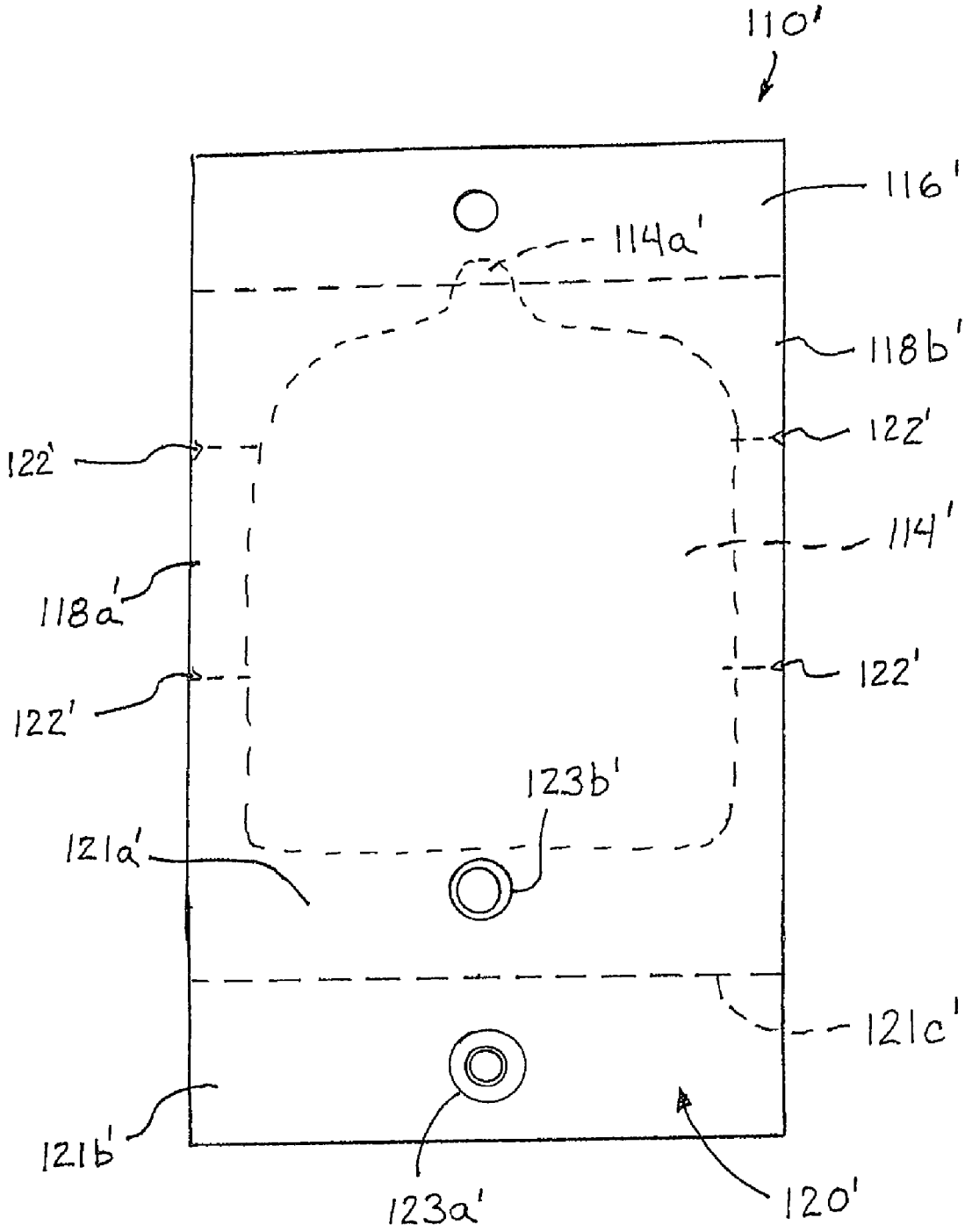
FIG. 7 is a plan view of another flexible pouch in accordance with the present invention.

Optionally, and with reference to FIG. 7, a base 120' of a container 110' may be folded over on itself to form a substantially rigid and thicker folded base or clip (such as in a similar manner as described above with respect to container 10) at the lower end of the container or the end opposite the dispensing portion or opening 114*a*' of the cavity 114' and thus opposite the header portion 116' of container 110'. The base 120' may have a weakened portion 121*c*', such as a crease or notch or perforation or the like, that generally bisects the base 120' into an upper base portion 121*a*' and a lower base portion 121*b*'. The base 120' is folded such that the lower base portion 121*b*' overlays the upper base portion 121*a*' to provide a dual thickness base or clip (in other words, the folded base portion has a thickness of four sheet portions or layers of the container since each of the base portions comprises two sheet portions sealed together) for the user to grasp to assist in folding the container at the weakened portion or portions along the container, such as weakened portions 122' at the side regions 118*a*', 118*b*'.

Optionally, container 110' may include fastener indicia or the like at the base 120' to indicate to the user how the base is to be folded. For example, the container 110' may have a first fastener portion or element or indicia 123*a*' printed or screen printed or otherwise established at the second or lower base portion 121*b*', and a second fastener portion or element or indicia 123*b*' printed or screen printed or otherwise established at the first or upper base portion 121*a*'. As discussed above, the fastener indicia are graphical representations that are indicative or representative of first and second fastener portions (such as male and female fastener portions, such as snap elements or the like), and are established at the sheet portion in a manner whereby the first and second indicia 123*a*', 123*b*' may be generally aligned when the second base portion 121*b* is folded generally over the first base portion 121*a*'. The first and second fastener indicia thus provide an indication to the user of the pouch container that the second base portion is to be folded at the weakened portion of the base. Optionally, the base portion may also or otherwise include indicia 121*c*' across or partially across the base portion 120' and generally at the weakened portion 120*a*' to provide an indication of where the base portion is to be folded (such as a dashed line or text, such as "fold here", or the like). As stated above, such indicia or demarcation is particularly useful when the weakened portion of the base is a crease or other form of weakening of the base and thus may not be readily discernible to the user of the container. Container 110' may otherwise be substantially similar to container 110, such that a detailed discussion of the containers need not be repeated herein.

Thus, the present invention provides a means for directing and/or controlling the flow of the flowable material within the container or pouch toward and through and out from the dispensing opening of the pouch. The foldable substantially rigid region of the container, such as the substantially rigid side regions and/or foldable substantially rigid base region, allow for controlled directing of the fluid flow of the pouch and may build up the pressure internally within the pouch to provide a more complete evacuation or expulsion of the flowable material within the pouch. The weakened portion or portions are formed at or near the base region to allow folding of the container at or near the base region (such as across the base region or at the side regions and across a lower or distal portion of the cavity opposite the dispensing end) so that the pressure due to the folding of the pouch starts at the end of the pouch that is opposite from the dispensing and/or evacuation point. The present invention provides a weakened portion of the substantially rigid base and/or side regions to allow for controlled bending or folding of the container at the weakened portions, while the rest of the base and/or side regions (the non-weakened portions) remain relatively rigid or stiff. Optionally, indicia may be provided at one or both of the sheet portions of the container to provide an indication to a user of the folding feature of the pouch container. Optionally, tapered shoulders may be provided near the dispensing end of the pouch to further direct the flow of the material within the pouch toward the dispensing opening of the pouch.

Therefore, the present invention provides a relatively simple and inexpensive one or two piece pouch construction with no cap or molded shoulders or re-sealable outlet or the like, but with the ability to readily dispense the flowable material within the pouch via controlled folding of the pouch along the series of weakened portions at or in the side regions of the pouch. The simple, low cost pouch of the present invention provides a cavity that is framed by a series of side ridges and weakened portions that are made of the same material and same sheet or sheets as the pouch holder such that no additional material or element is added to the pouch to provide the desired controlled expulsion of the materials within the pouch. The selective use of the substantially rigid side and bottom regions with weakened portions, such as creases, notches, folds or the like, produces a means for constructing a fold up device or container or pouch that directs product pressure and outflow of material to and through the dispensing opening of the pouch in a controlled manner.

Changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. A container for containing a flowable material, said container comprising:

first and second sheet portions sealed together to form a sealed perimeter portion along a perimeter of said container to define a closed cavity for containing said flowable material, said cavity including a dispensing portion at a periphery of said container, said dispensing portion being configured for dispensing said flowable material from said cavity when said dispensing portion is opened;

said perimeter including a base and opposite side regions of said container; and wherein at least one of said base and said side regions of said container comprises a substantially rigid region in which said sealed perimeter portion has a first width, and at least one weakened portion in which said sealed perimeter portion has a second width, wherein said second width is less than said first width to facilitate folding of said substantially rigid region at said at least one weakened portion to fold a distal portion of said container distal from said dispensing portion at least partially over a proximate portion of said container proximate said dispensing portion to assist in dispensing said flowable material from said container.

2. The container of claim 1, wherein said perimeter of said container includes a header portion at an end of said container opposite said base.

3. The container of claim 1, wherein said substantially rigid region comprises said side regions and said at least one weakened portion comprises a plurality of weakened portions spaced along the respective side regions to facilitate sequential folding of said side regions at corresponding opposite pairs of said weakened portions to assist in dispensing said flowable material from said container.

4. The container of claim 1, wherein said substantially rigid region comprises said base, and wherein said base is foldable along said weakened portion of said base, said base portion being folded at said weakened portion whereby a folded portion of said base at least partially overlies and is urged against one of said sheet portions at said cavity of said container to form an expulsion element to assist in dispensing said flowable material from said container.

5. A container for containing a flowable material, said container comprising:

first and second sheet portions sealed together along a perimeter of said container to define a closed cavity for containing said flowable material, said cavity including a dispensing portion at a periphery of said container, said dispensing portion being configured for dispensing said flowable material from said cavity when said dispensing portion is opened;

said perimeter including a base and opposite side regions of said container;

wherein at least one of said base and said side regions of said container comprises a substantially rigid region with at least one weakened portion to facilitate folding of said substantially rigid region at said at least one weakened portion to assist in dispensing said flowable material from said container; and wherein said first sheet portion has first and second indicia thereon, said first indicia being representative of a first fastener portion and said second indicia being representative of a second fastener portion, said first and second indicia being generally aligned when said substantially rigid region is folded at said at least one weakened portion and provides an indication that said substantially rigid region is to be folded at said at least one weakened portion.

6. A container for containing a flowable material, said container comprising:

first and second sheet portions sealed together to form a sealed perimeter portion along a perimeter of said container to define a closed cavity for containing said flowable material, said cavity including a dispensing portion at a periphery of said container, said dispensing portion being configured for dispensing said flowable material from said cavity when said dispensing portion is opened;

said perimeter including a base and opposite side regions of said container; and wherein said side regions of said container comprise substantially rigid side regions in which said sealed perimeter portion has a substantially constant greater width, with at least one weakened portion in which said sealed perimeter portion has a substantially reduced width at each of said substantially rigid side regions to facilitate folding of said side regions at said at least one weakened portion so that a distal portion of said container distal from said dispensing portion is foldable at least partially over a proximate portion of said container proximate said dispensing portion to assist in dispensing said flowable material from said container.

7. The container of claim 6, wherein said perimeter of said container includes a header portion at an end of said container opposite said base.

8. The container of claim 7, wherein said header portion includes a means for hanging said container.

9. The container of claim 7, wherein said header portion includes an opening line at least partially thereacross, said header portion being cut or torn along said opening line to open said dispensing portion.

10. The container of claim 6, wherein said at least one weakened portion comprises a plurality of weakened portions spaced along the respective side regions to facilitate folding of said side regions at said weakened portions to assist in dispensing said flowable material from said container.

11. The container of claim 10, wherein weakened portions at one side region generally correspond to weakened portions at the other side region to facilitate folding of said container at said corresponding weakened portions.

12. The container of claim 10, wherein said weakened portions comprise notches established at said substantially rigid side regions, said notches at one side region generally corresponding to said notches at the other side region to facilitate folding of said container at said corresponding notches.

13. The container of claim 10, wherein said weakened portions comprise creases established at said substantially rigid side regions, said creases at one side region generally corresponding to said creases at the other side region to facilitate folding of said container at said corresponding creases.

14. The container of claim 10, wherein said weakened portions are substantially evenly spaced along said side regions.

15. The container of claim 10, wherein said weakened portions are unevenly spaced along said side regions.

16. The container of claim 15, wherein a space between a first pair of adjacent weakened portions is less than a space between a second pair of adjacent weakened portions, said first pair being closer to said base of said container than said second pair.

17. The container of claim 6, wherein said base comprises a substantially rigid sealed base.

18. The container of claim 17, wherein said base is foldable along a weakened portion of said base to form an expulsion element to assist in dispensing said flowable material from said container.

19. The container of claim 18, wherein said base comprises a first base portion at an end region of said cavity and a second base portion extending from said first base portion and away from said cavity, said weakened portion being disposed where said first and second base portions oppose one another, said base portion being folded at said weakened portion whereby said second base portion at least partially overlies and is urged against one of said sheet portions at said cavity of said container.

20. The container of claim 17, wherein said base comprises a squeegee clip.

21. The container of claim 6, wherein said dispensing portion is opened by tearing a header portion of said container.

22. The container of claim 6, wherein said dispensing portion is opened by cutting a header portion of said container.

23. A container for containing a flowable material, said container comprising:

first and second sheet portions sealed together along a perimeter of said container to define a closed cavity for containing said flowable material, said cavity including a dispensing portion at a periphery of said container, said dispensing portion being configured for dispensing said flowable material from said cavity when said dispensing portion is opened;

said first sheet portion having first and second indicia thereon, said first indicia being at least one of (a) disposed at said base portion and (b) disposed at said cavity, and said second indicia being disposed at said cavity and closer to said dispensing portion than said first indicia, said first and second indicia providing an indication that said container, is to be folded at said weakened portion;

said perimeter including a base and opposite side regions of said container; and wherein said side regions of said container comprise substantially rigid side regions with at least one weakened portion at each of said substantially rigid side regions to facilitate folding of said side regions at said at least one weakened portion so that a distal portion of said container distal from said dispensing portion is folded at least partially over a proximate portion of said container proximate said dispensing portion to assist in dispensing said flowable material from said container.

24. A container for containing a flowable material, said container comprising:

first and second sheet portions sealed together along a perimeter of said container to define a closed cavity for containing said flowable material, said cavity including a dispensing portion at a periphery of said container, said dispensing portion being configured for dispensing said flowable material from said cavity when said dispensing portion is opened;

said perimeter including a base and opposite side regions of said container;

wherein said side regions of said container comprise substantially rigid side regions with at least one weakened portion at each of said substantially rigid side regions to facilitate folding of said side regions at said at least one weakened portion to assist in dispensing said flowable material from said container; and wherein said first sheet portion has first and second indicia thereon, said first indicia being at least one of (a) disposed at said base portion and (b) disposed at said cavity, and said second indicia being disposed at said cavity and closer to said dispensing portion than said first indicia, said first and second indicia providing an indication that said container is to be folded at said weakened portion, and wherein said first indicia is representative of a first fastener portion and said second indicia is representative of a second fastener portion, said first and second indicia being generally aligned when said container is substantially folded at said weakened portion.

25. A method for expelling flowable material from a sealed pouch container, said method comprising:

providing first and second sheet portions and selectively sealing said sheet portions together along a perimeter region of said container to define a closed cavity for containing a flowable material therein, said perimeter including a base and opposite side regions of said container, said cavity including a dispensing portion at a periphery of said container, wherein said side regions of said container comprise substantially rigid side regions with at least one weakened portion at each of said substantially rigid side regions;

opening said dispensing portion; and folding said side regions at a first one of said at least one weakened portion so that a distal portion of said container distal from said dispensing portion at least partially overlaps a proximate portion of said container proximate said dispensing portion to assist in dispensing said flowable material through said opened dispensing portion and from said container.

26. The method of claim 25, wherein said at least one weakened portion comprises a plurality of weakened portions spaced along the respective side regions.

27. The method of claim 26 further comprising folding said side regions at a second one of said weakened portions to dispense more of the flowable material through said opened dispensing portion, said second weakened portion being closer to said dispensing portion than said first weakened portion.

28. The method of claim 27 further comprising folding said side regions at a third one of said weakened portions to dispense more of the flowable material through said opened dispensing portion, said third weakened portion being closer to said dispensing portion than said second weakened portion.

29. The method of claim 28, wherein a space between said first and second weakened portions is less than a space between said second and third weakened portions.

30. The method of claim 28, wherein a space between said first and second weakened portions is approximately equal to a space between said second and third weakened portions.

31. The method of claim 26, wherein weakened portions at one side region generally correspond to weakened portions at the other side region to facilitate folding of said container at said corresponding weakened portions.

32. The method of claim 26, wherein said weakened portions comprise notches established at said substantially rigid side regions, said notches at one side region generally corresponding to said notches at the other side region to facilitate folding of said container at said corresponding notches.

33. The method of claim 26, wherein said weakened portions comprise creases established at said substantially rigid side regions, said creases at one side region generally corresponding to said creases at the other side region to facilitate folding of said container at said corresponding creases.

34. The method of claim 25, wherein said perimeter of said container includes a header portion at an end of said container opposite said base.

35. The method of claim 34, wherein said header portion includes a means for hanging said container.

36. The method of claim 34, wherein said header portion includes an opening line at least partially thereacross, said header portion being cut or torn along said opening line to open said dispensing portion.

37. The method of claim 25, wherein said base comprises a substantially rigid sealed base with at least one weakened base portion, and wherein said method further comprises folding said base at said weakened base portion to assist in dispensing said flowable material through said opened dispensing portion and from said container.

38. The method of claim 37, wherein said base comprises a first base portion at an end region of said cavity and a second base portion extending from said first base portion and away from said cavity, said weakened portion being disposed where said first and second base portions oppose one another, said base portion being folded at said weakened portion whereby said second base portion at least partially overlies and is urged against one of said sheet portions at said cavity of said container.

39. A method for expelling flowable material from a sealed pouch container, said method comprising:

providing first and second sheet portions and selectively sealing said sheet portions together along a perimeter region of said container to define a closed cavity for containing a flowable material therein, said perimeter including a base and opposite side regions of said container, said cavity including a dispensing portion at a periphery of said container, wherein said side regions of said container comprise substantially rigid side regions with at least one weakened portion at each of said substantially rigid side regions;

opening said dispensing portion;

folding said side regions at a first one of said at least one weakened portion to assist in dispensing said flowable material through said opened dispensing portion and from said container;

wherein said base comprises a substantially rigid sealed base with at least one weakened base portion, and wherein said method further comprises folding said base at said weakened base portion to assist in dispensing said flowable material through said opened dispensing portion and from said container; and wherein said base comprises a first base portion at an end region of said cavity and a second base portion extending from said first base portion and away from said cavity, said weakened portion being disposed where said first and second base portions oppose one another, said base portion being folded at said weakened portion whereby said second base portion at least partially overlies and is urged against one of said sheet portions at said cavity of said container, and wherein said first base portion has first indicia thereon that is indicative of a first fastener portion and said second base portion has second indicia thereon that is indicative of a second fastener portion, said first and second indicia being generally aligned when said second base portion is folded generally over said first base portion, said first and second indicia providing an indication that said second base portion is to be folded over said first base portion.

40. The method of claim 25, wherein opening said dispensing portion comprises tearing a header portion of said container at said dispensing portion.

41. The method of claim 25, wherein opening said dispensing portion comprises cutting a header portion of said container at said dispensing portion.

42. The method of claim 25, wherein said first sheet portion has first and second indicia thereon, said first indicia being at least one of (a) disposed at said base portion and (b) disposed at said cavity, and said second indicia being disposed at said cavity and closer to said dispensing portion than said first indicia, said first and second indicia providing an indication that said container is to be folded at said weakened portion.

43. A method for expelling flowable material from a sealed pouch container, said method comprising:

providing first and second sheet portions and selectively sealing said sheet portions together along a perimeter region of said container to define a closed cavity for containing a flowable material therein, said perimeter including a base and opposite side regions of said container, said cavity including a dispensing portion at a periphery of said container, wherein said side regions of said container comprise substantially rigid side regions with at least one weakened portion at each of said substantially rigid side regions;

opening said dispensing portion;

folding said side regions at a first one of said at least one weakened portion to assist in dispensing said flowable material through said opened dispensing portion and from said container; and wherein said first sheet portion has first and second indicia thereon, said first indicia being at least one of (a) disposed at said base portion and (b) disposed at said cavity, and said second indicia being disposed at said cavity and closer to said dispensing portion than said first indicia, said first and second indicia providing an indication that said container is to be folded at said weakened portion, and wherein said first indicia is representative of a first fastener portion and said second indicia is representative of a second fastener portion, said first and second indicia being generally aligned when said container is substantially folded at said weakened portion.

44. A container for containing a flowable material, said container comprising:

first and second sheet portions sealed together along a perimeter of said container to define a closed cavity for containing said flowable material, said cavity including a dispensing portion at a periphery of said container, said dispensing portion being configured for dispensing said flowable material from said cavity when said dispensing portion is opened;

said perimeter including a base and opposite side regions of said container; and wherein said base of said container comprises a substantially rigid base having a base width defined between said cavity and an outer edge opposite said cavity, with a weakened portion extending across said base between said side regions and spaced outwardly from said cavity by less than half the base width to facilitate folding of said base at said weakened portion, whereby, when said base is folded at said weakened portion, the folded portion of said base at least partially overlies and is urged against one of said sheet portions at said cavity to assist in dispensing said flowable material from said container.

45. The container of claim 44, wherein said perimeter of said container includes a header portion at an end of said container opposite said base.

46. The container of claim 45, wherein said header portion includes a means for hanging said container.

47. The container of claim 45, wherein said header portion includes an opening line at least partially thereacross, said header portion being cut or torn along said opening line to open said dispensing portion.

48. The container of claim 44, wherein said side regions comprise substantially rigid side regions with a plurality of weakened portions spaced therealong to facilitate folding of said side regions at said weakened portions to assist in dispensing said flowable material from said container.

49. The container of claim 48, wherein weakened portions at one side region generally correspond to weakened portions at the other side region to facilitate sequential folding of said container at said corresponding weakened portions.

50. The container of claim 48, wherein said weakened portions comprise notches established at said substantially rigid side regions, said notches at one side region generally corresponding to said notches at the other side region to facilitate folding of said container at said corresponding notches.

51. The container of claim 48, wherein said weakened portions comprise creases established at said substantially rigid side regions, said creases at one side region generally corresponding to said creases at the other side region to facilitate folding of said container at said corresponding creases.

52. The container of claim 48, wherein said weakened portions are substantially evenly spaced along said side regions.

53. The container of claim 48, wherein said weakened portions are unevenly spaced along said side regions.

54. The container of claim 53, wherein a space between a first pair of adjacent weakened portions is less than a space between a second pair of adjacent weakened portions, said first pair being closer to said base of said container than said second pair.

55. The container of claim 44, wherein said base comprises a squeegee clip.

56. The container of claim 44, wherein said dispensing portion is opened by tearing a header portion of said container.

57. The container of claim 44, wherein said dispensing portion is opened by cutting a header portion of said container.

58. The container of claim 44, wherein said base comprises a first base portion at an end region of said cavity and a second base portion extending from said first base portion and away from said cavity, said weakened portion being disposed where said first and second base portions oppose one another, said base portion being folded at said weakened portion whereby said second base portion at least partially overlies and is urged against one of said sheet portions at said cavity of said container.

59. A container for containing a flowable material, said container comprising:

first and second sheet portions sealed together along a perimeter of said container to define a closed cavity for containing said flowable material, said cavity including a dispensing portion at a periphery of said container, said dispensing portion being configured for dispensing said flowable material from said cavity when said dispensing portion is opened;

said first sheet portion having first and second indicia thereon, said first indicia being disposed at said folded portion of said base and said second indicia being at least one of (a) disposed at a non-folded portion of said base and (b) disposed at said cavity, said first and second indicia providing an indication that said folded base portion is to be folded at said weakened portion of said base;

said perimeter including a base and opposite side regions of said container; and wherein said base of said container comprises a substantially rigid base with a weakened portion to facilitate folding of said base at said weakened portion, whereby, when said base is folded at said weakened portion, the folded portion of said base at least partially overlies and is urged against one of said sheet portions at said cavity to assist in dispensing said flowable material from said container.

60. A container for containing a flowable material, said container comprising:

first and second sheet portions sealed together along a perimeter of said container to define a closed cavity for containing said flowable material, said cavity including a dispensing portion at a periphery of said container, said dispensing portion being configured for dispensing said flowable material from said cavity when said dispensing portion is opened;

said perimeter including a base and opposite side regions of said container;

wherein said base of said container comprises a substantially rigid base with a weakened portion to facilitate folding of said base at said weakened portion, whereby the folded portion of said base at least partially overlies and is urged against one of said sheet portions at said cavity to assist in dispensing said flowable material from said container; and wherein said first sheet portion has first and second indicia thereon, said first indicia being disposed at said folded portion of said base and said second indicia being at least one of (a) disposed at a non-folded portion of said base and (b) disposed at said cavity, said first and second indicia providing an indication that said folded base portion is to be folded at said weakened portion of said base, and wherein said first indicia is representative of a first fastener portion and said second indicia is representative of a second fastener portion, said first and second indicia being generally aligned when said base is folded generally over at least one of (a) said non-folded portion of said base and (b) said cavity.

61. The container of claim 60, wherein said first indicia is representative of a first snap portion and said second indicia is representative of a second snap portion.

62. The container of claim 59, wherein said base includes indicia across said base and generally at said weakened portion to provide an indication of where said base is to be folded.

63. A method for expelling flowable material from a sealed pouch container, said method comprising:

providing first and second sheet portions and selectively sealing said sheet portions together along a perimeter region of said container to define a closed cavity for containing a flowable material therein, said perimeter including a base and opposite side regions of said container, said cavity including a dispensing portion at a periphery of said container, wherein said base of said container comprises a substantially rigid base with at least one weakened portion;

opening said dispensing portion; and folding said base at said weakened portion whereby the folded portion of said base at least partially overlies one of said sheet portions and urging the folded portion of said base against one of said sheet portions at said cavity to assist in dispensing said flowable material through said opened dispensing portion and from said container.

64. The method of claim 63, wherein said side regions comprise substantially rigid side regions with a plurality of weakened portions spaced therealong, said method further comprising folding said side regions at a first one of said weakened portions to assist in dispensing said flowable material through said opened dispensing portion and from said container.

65. The method of claim 64 further comprising folding said side regions at a second one of said weakened portions to dispense more of the flowable material through said opened dispensing portion, said second weakened portion being closer to said dispensing portion than said first weakened portion.

66. The method of claim 65 further comprising folding said side regions at a third one of said weakened portions to dispense more of the flowable material through said opened dispensing portion, said third weakened portion being closer to said dispensing portion than said second weakened portion.

67. The method of claim 66, wherein a space between said first and second weakened portions is less than a space between said second and third weakened portions.

68. The method of claim 66, wherein a space between said first and second weakened portions is approximately equal to a space between said second and third weakened portions.

69. The method of claim 64, wherein weakened portions at one side region generally correspond to weakened portions at the other side region to facilitate folding of said container at said corresponding weakened portions.

70. The method of claim 64, wherein said weakened portions comprise notches established at said substantially rigid side regions, said notches at one side region generally corresponding to said notches at the other side region to facilitate folding of said container at said corresponding notches.

71. The method of claim 64, wherein said weakened portions comprise creases established at said substantially rigid side regions, said creases at one side region generally corresponding to said creases at the other side region to facilitate folding of said container at said corresponding creases.

72. The method of claim 63, wherein said perimeter of said container includes a header portion at an end of said container opposite said base.

73. The method of claim 72, wherein said header portion includes a means for hanging said container.

74. The method of claim 72, wherein said header portion includes an opening line at least partially thereacross, said header portion being cut or torn along said opening line to open said dispensing portion.

75. The method of claim 63, wherein opening said dispensing portion comprises tearing a header portion of said container at said dispensing portion.

76. The method of claim 63, wherein opening said dispensing portion comprises cutting a header portion of said container at said dispensing portion.

77. The method of claim 63, wherein said base comprises a first base portion at an end region of said cavity and a second base portion extending from said first base portion and away from said cavity, said weakened portion being disposed where said first and second base portions oppose one another, said base portion being folded at said weakened portion whereby said second base portion at least partially overlies and is urged against one of said sheet portions at said cavity of said container.

78. The method of claim 63, wherein said first sheet portion has first and second indicia thereon, said first indicia being disposed at said folded base portion and said second indicia being at least one of (a) disposed at a non-folded portion of said base and (b) disposed at said cavity, said first and second indicia providing an indication that said folded base portion is to be folded at said weakened portion of said base.

79. A method for expelling flowable material from a sealed pouch container, said method comprising:

providing first and second sheet portions and selectively sealing said sheet portions together along a perimeter region of said container to define a closed cavity for containing a flowable material therein, said perimeter including a base and opposite side regions of said container, said cavity including a dispensing portion at a periphery of said container, wherein said base of said container comprises a substantially rigid base with at least one weakened portion;

opening said dispensing portion;

folding said base at said weakened portion whereby the folded portion of said base at least partially overlies and is urged against one of said sheet portions at said cavity to assist in dispensing said flowable material through said opened dispensing portion and from said container; and wherein said first sheet portion has first and second indicia thereon, said first indicia being disposed at said folded base portion and said second indicia being at least one of (a) disposed at a non-folded portion of said base and (b) disposed at said cavity, said first and second indicia providing an indication that said folded base portion is to be folded at said weakened portion of said base, and wherein said first indicia is indicative of a first fastener portion and said second indicia is indicative of a second fastener portion, said first and second indicia being generally aligned when said folded base portion is folded generally over at least one of (a) said non-folded base portion and (b) said cavity.

80. The method of claim 79, wherein said first indicia is representative of a first snap portion and said second indicia is representative of a second snap portion.

81. The method of claim 78, wherein said base includes indicia across said base and generally at said weakened portion to provide an indication of where said base is to be folded.

82. A method for expelling flowable material from a sealed pouch container, said method comprising:

providing first and second sheet portions and selectively sealing said sheet portions together along a perimeter region of said container to define a closed cavity for containing a flowable material therein, said perimeter including a base, and opposite side regions of said container, said cavity including a dispensing portion at a periphery of said container, wherein said side regions of said container comprise substantially rigid side regions with first and second weakened portions at each of said substantially-rigid side regions, with said second weakened portion being closer to said dispensing portion than said first weakened portion, wherein weakened portions at one side region generally correspond to respective weakened portions at the other side region to facilitate folding of said container at said corresponding weakened portions, and wherein a distal portion of said container is distal from said dispensing portion and opposite said first weakened portion from said dispensing portion, and wherein an intermediate portion of said container is between said first and second weakened portions, and wherein a proximate portion of said container is between said second weakened portion and said dispensing portion;

opening said dispensing portion;

folding said side regions at said first weakened portion so that said distal portion of said container at least partially overlaps said intermediate portion of said container and urging said distal portion against said intermediate portion to assist in urging said flowable material in said container toward said dispensing portion for dispensing said flowable material through said opened dispensing portion and from said container; and folding said side regions at said second weakened portion so that said distal and intermediate portions of said container at least partially overlap said proximate portion of said container and urging said intermediate portion toward said proximate portion to assist in urging said flowable material in said container toward said dispensing portion for dispensing said flowable material through said opened dispensing portion and from said container.

83. The method of claim 82, further comprising folding said side regions at a third weakened portion between said second weakened portion and said dispensing portion to assist in urging said flowable material in said container toward said dispensing portion for dispensing said flowable material through said opened dispensing portion and from said container.

84. The method of claim 83, wherein a space between said first and second weakened portions is less than a space between said second and third weakened portions.

85. The method of claim 83, wherein a space between said first and second weakened portions is approximately equal to a space between said second and third weakened portions.

86. The method of claim 82, wherein said weakened portions comprise one of (a) notches established at said substantially rigid side regions, said notches at one side region generally corresponding to said notches at the other side region to facilitate folding of said container at said corresponding notches, and (b) creases established at said substantially rigid side regions, said creases at one side region generally corresponding to said creases at the other side region to facilitate folding of said container at said corresponding creases.

87. The method of claim 82, wherein said base comprises a substantially rigid sealed base with at least one weakened base portion, and wherein said method further comprises:

folding said base at said weakened base portion so that a distal base portion at a distal side of said weakened base portion from said dispensing portion at least partially overlaps said distal portion of said container; and urging said distal base portion against said distal portion of said container to assist in urging said flowable material in said container toward said dispensing portion for dispensing said flowable material through said opened dispensing portion and from said container.

88. A method for expelling flowable material from a sealed pouch container, said method comprising:

providing first and second sheet portions and selectively sealing said sheet portions together along a perimeter region of said container to define a closed cavity for containing a flowable material therein, said perimeter including a base and opposite side regions of said container, said cavity including a dispensing portion at a periphery of said container, wherein said side regions of said container comprise substantially rigid side regions with first and second weakened portions at each of said substantially rigid side regions, with said second weakened portion being closer to said dispensing portion than said first weakened portion, wherein weakened portions at one side region generally correspond to respective weakened portions at the other side region to facilitate folding of said container at said corresponding weakened portions, and wherein a distal portion of said container is distal from said dispensing portion and opposite said first weakened portion from said dispensing portion, and wherein an intermediate portion of said container is between said first and second weakened portions, and wherein a proximate portion of said container is between said second weakened portion and said dispensing portion;

opening said dispensing portion;

folding said side regions at said first weakened portion so that said distal portion of said container at least partially overlaps said intermediate portion of said container and urging said distal portion against said intermediate portion to assist in urging said flowable material in said container toward said dispensing portion for dispensing said flowable material through said opened dispensing portion and from said container;

folding said side regions at said second weakened portion so that said distal and intermediate portions of said container at least partially overlap said proximate portion of said container and urging said intermediate portion toward said proximate portion to assist in urging said flowable material in said container toward said dispensing portion for dispensing said flowable material through said opened dispensing portion and from said container; and wherein said distal portion of said container has first indicia thereon and said intermediate portion of said container has second indicia thereon, and wherein said method comprises folding said side regions at said first weakened portion so that said distal portion of said container at least partially overlaps said intermediate portion of said container and so that said first and second indicia are generally aligned with one another.

* * * * *

UNITED STATES PATENT AND TRADEMARK OFFICE

CERTIFICATE OF CORRECTION

PATENT NO. : 8,061,563 B1
APPLICATION NO. : 11/754650
DATED : November 22, 2011
INVENTOR(S) : Ian K. Rosen It is certified that error appears in the above-identified patent and that said Letters Patent is hereby corrected as shown below:

In the Specification:

Column 8,
Line 5, "foamed" should be --formed--

In the Claims:

Column 13, in Claim 23,
Line 60, Delete "," after "container"

Column 21, in Claim 82,
Line 3, Delete "," after "base"

Signed and Sealed this
Eighteenth Day of December, 2012

David J. Kappos

David J. Kappos
*Director of the United States Patent and Trademark Office*